United States Patent [19]

Inomata

[11] Patent Number: 4,505,122

[45] Date of Patent: Mar. 19, 1985

[54] VARIABLE DELIVERY COMPRESSOR

[75] Inventor: Kenichi Inomata, Konan, Japan

[73] Assignee: Diesel Kiki Co., Ltd., Tokyo, Japan

[21] Appl. No.: 538,199

[22] Filed: Oct. 3, 1983

[30] Foreign Application Priority Data

Oct. 8, 1982 [JP] Japan ..... 57-177280

[51] Int. Cl.[3] ..... F04B 49/00

[52] U.S. Cl. ..... 62/133; 62/228.5; 137/625.31; 417/286

[58] Field of Search ..... 62/228.5, 133, 196.2, 62/196.3; 417/286, 297; 137/625.31

[56] References Cited

U.S. PATENT DOCUMENTS

| | | | |
|---|---|---|---|
| 2,633,325 | 3/1953 | Whitlock, Jr. | 137/625.31 |
| 4,328,831 | 5/1982 | Wolff | 137/625.31 |
| 4,403,921 | 9/1983 | Kato et al. | 417/297 |

*Primary Examiner*—William E. Wayner

*Attorney, Agent, or Firm*—Frishauf, Holtz, Goodman & Woodward

[57] ABSTRACT

In a multicylinder/double acting compressor, front and rear discharge chambers as well as front and rear suction chambers are out of communication with each other within the compressor. Arranged in one of the discharge chambers is a discharge valve formed of a rotary valve, which is disposed to close discharge ports communicating associated cylinder chambers with the same discharge chamber. The discharge valve is adapted to keep all the above discharge ports opened. An electromagnetic stop valve is connected between the above discharge chamber and an associated compression fluid circuit, for interrupting the communication therebetween. Half delivery operation of the compressor is carried out while the discharge ports are kept opened by the discharge valve and simultaneously the stop valve is closed, to establish communication between all the associated cylinder chambers and the discharge chamber through the opened discharge ports, whereby compression fluid is moved between the individual cylinder chambers without being compressed and expanded, as the pistons are reciprocated within the respective cylinder chambers.

8 Claims, 5 Drawing Figures

III
III
1
1a
1a'
1b
1b
2
2a
2'
3
3
3a
4
4a
5
5'
6
7
7'
8
8'
9
9'
10
10'
11
11'
12
12'
13
13'
14
15
15'
16
16'
17
17'
18
18'
19
19'
20
20'
20'a
21
21'
22
22'
24
25
26
27
28
29
30
31
34

VARIABLE DELIVERY COMPRESSOR

BACKGROUND OF THE INVENTION

This invention relates to variable delivery compressors of the multicylinder/double acting type, and more particularly to compressors of this kind which are highly efficient with minimum loss of power during reduced delivery operation.

Compressors for use in air conditioning systems for vehicles are usually driven by engines installed on the vehicles, and have their total displacement or delivery quantity set at values suitable to ensure that the temperature within the compartment of a vehicle, which has risen to a high value during parking under the scorching sun, can be lowered promptly after the start of the engine of the vehicle. As a result, when the engine operation continues at a mean speed, for instance at a cruising speed for some period of time after the start of the engine, the cooling capacity of such a compressor can increase to an excessive degree. Therefore, when the cooling capacity of the compressor increases to an excessive degree during high speed operation of the engine, it is necessary to control the delivery quantity of the compressor to a smaller value for economy of power as well as for prevention of overcooling. Also when there occurs a drop in the cooling load on the air conditioning system, the delivery quantity of the compressor should be controlled to a smaller value, for the same purposes as above. Conventionally, as a simple means for varying the delivery quantity of such a compressor, a step control method is known which renders part of the cylinders of the compressor substantially ineffective by bypassing their discharge side to their suction side.

However, if such a step control method is applied to a multicylinder/double acting type compressor, compression of compression fluid or refrigerant and discharge of same through the discharge valves are continuously carried out on the side of the substantially ineffective cylinders due to reciprocating motions of the pistons within these cylinders. That is, during such reduced delivery operation, the power consumption is not reduced in proportion to the number of cylinders rendered ineffective, and is still larger for the number of the other effective cylinders. Further, due to discharge resistance of the discharge valves, the pressure and temperature of compression fluid discharged from the ineffective cylinders increase, and this compression fluid is sucked into the other effective cylinders, resulting in an increase in the temperature of the discharge fluid.

SUMMARY OF THE INVENTION

It is an object of the invention to provide a variable delivery compressor which is capable of performing a reduced delivery operation, with the power consumption reduced in proportion to the number of cylinders which are rendered ineffective, and without causing an increase in the discharge fluid temperature as well as an increase in the loss of power.

It is a further object of the invention to provide a variable delivery compressor which is provided with a discharge valve mechanism for positively holding the discharge ports of part of the cylinders in a closed position for normal valving action and in an open position for keeping the part of the cylinders substantially ineffective, and a control means responsive to control parameters for automatically controlling the discharge valve mechanism.

According to the invention, a double acting compressor is provided which includes a cylinder block formed therein with two groups of cylinders, the cylinders of each group being circumferentially arranged at equal intervals and extending parallel with each other, mutually corresponding ones of the cylinders of the two groups being axially aligned with each other. The compressor is characterized by the following arrangement: Front and rear suction chambers, which are formed within cylinder heads secured to opposite ends of the cylinder block, are out of communication with each other within the compressor. Also, front and rear discharge chambers, which are formed within the cylinder heads, are out of communication with each other within the compressor. Arranged in one of the discharge chambers is a discharge valve formed of a rotary valve, which is disposed to close a plurality of discharge ports communicating respective ones of cylinder chambers defined within the cylinders of one of the groups with the above one discharge chamber. The compressor further includes changeover means for selectively causing the discharge valve to assume a first position where the discharge valve keeps all the discharge ports closed for normal valving action thereof, and a second position where the discharge valve keeps all the discharge ports opened, a stop valve connected between the above one discharge chamber and one side of a compression fluid circuit associated with the compressor, for interrupting the communication therebetween, and control means for controlling the changeover means and the stop valve in synchronism with each other. The control means is operable to cause the discharge valve to assume the second position through the changeover means, and at the same time to cause the stop valve to assume a closed position thereof.

The above and other objects, features and advantages of the invention will be more apparent from the ensuing detailed description taken in conjunction with the accompanying drawings.

DETAILED DESCRIPTION

Figure 1:
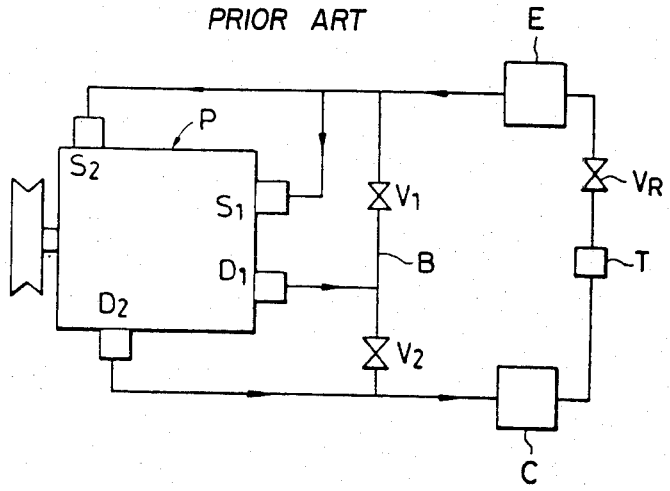
FIG. 1 PRIOR ART
FIG. 1 is a block diagram of an example of a conventional step control system for a compressor.

Referring first to FIG. 1, there is shown an example of a conventional step control system for a compressor for air conditioning systems. Discharge outlets D1 of parallel-arranged cylinders on one side, not shown, of the compressor P are connected, by way of a stop valve V1 in a bypass B, to a lower pressure side of a refrigerating circuit which is comprised of a condenser C, a receiver tank T, an expansion valve VR, and an evaporator E, and also connected, by way of another stop valve V2 in the bypass B, to a higher pressure side of the refrigerating circuit. To perform full delivery operation, the stop valve V1 is closed and at the same time the stop valve V2 is opened, so that compression fluid is sucked into the cylinders on opposite sides of the compressor P through suction inlets S1 and S2, compressed within the cylinders, and discharged through discharge outlets D1 and D2. To perform half delivery operation, the stop valve V1 is opened and at the same time the stop valve V2 is closed. In this position, the suction inlet S1 leading to the cylinders on one side is communicated with the discharge outlet D1 leading from the same cylinders via the bypass B, an accordingly the cylinders on the one side are rendered substantially ineffective, with fluid circulating between the same cylinders, while simultaneously only the cylinders on the other side are effectively operative.

However, according to such step control, during half delivery operation of the compressor, due to the discharge resistance of the discharge valves on the side of the ineffective cylinders, fluid is compressed and accordingly has its temperature increased, as the pistons are reciprocated within the ineffective cylinders. This heated compressed fluid is sucked into the effective cylinders on the other side. As a consequence, the discharge fluid temperature becomes higher.

The present invention is intended to eliminate the above drawbacks with the conventional step control. The concept of the invention is based upon the fact that in a multicylinder/double acting compressor wherein pistons are reciprocally moved within circumferentially parallel-arranged cylinders on each side with equal phase differences, the sum of volumes of the cylinder chambers defined within the same cylinders with the respective pistons in different phases remains constant all the time during operation of the compressor.

For instance, in a swash plate type compressor having three cylinders on each side, the volumes of the three cylinder chambers with equal phase differences between respective pistons are defined as follows:

$$V1=\pi d^2/4 \text{ Ro tan } \alpha(1-\cos\theta)$$

$$V2=\pi d^2/4 \text{ Ro tan } \alpha[1-\cos(\theta-\tfrac{2}{3}\pi)]$$

$$V3=\pi d^2/4 \text{ Ro tan } \alpha[1-\cos(\theta-4/3\pi)]$$

where V1, V2, and V3 represent the respective volumes of the three cylinder chambers, Ro the radius of the circumference along which the cylinders are arranged, $\alpha$ the angle of inclination of the swash plate, $\theta$ the angle of rotation of the swash plate, and d the radius of each cylinder, respectively.

Therefore, the sum V of the volumes of the cylinder chambers can be expressed as follows:

$$V = V1 + V2 + V3$$
$$= \pi d^2/4\, Ro \tan\alpha\, [3 - (\cos\theta + \cos(\theta - 2/3\,\pi) + \cos(\theta - 4/3\,\pi))]\cos(\theta - 2/3\,\pi) + \cos(\theta - 4/3\,\pi) = \pi d^2/4\; 3Ro \tan\alpha (= \text{constant})$$

It is thus noted that the sum V of the volumes of the cylinder chambers on each side remains constant all the time during operation of the compressor. The above equation can apply not only to a compressor having three cylinders on each side, but also to any other swash plate type compressor having a plurality of cylinders wherein the pistons are reciprocally moved with equal phase differences.

Figure 2:
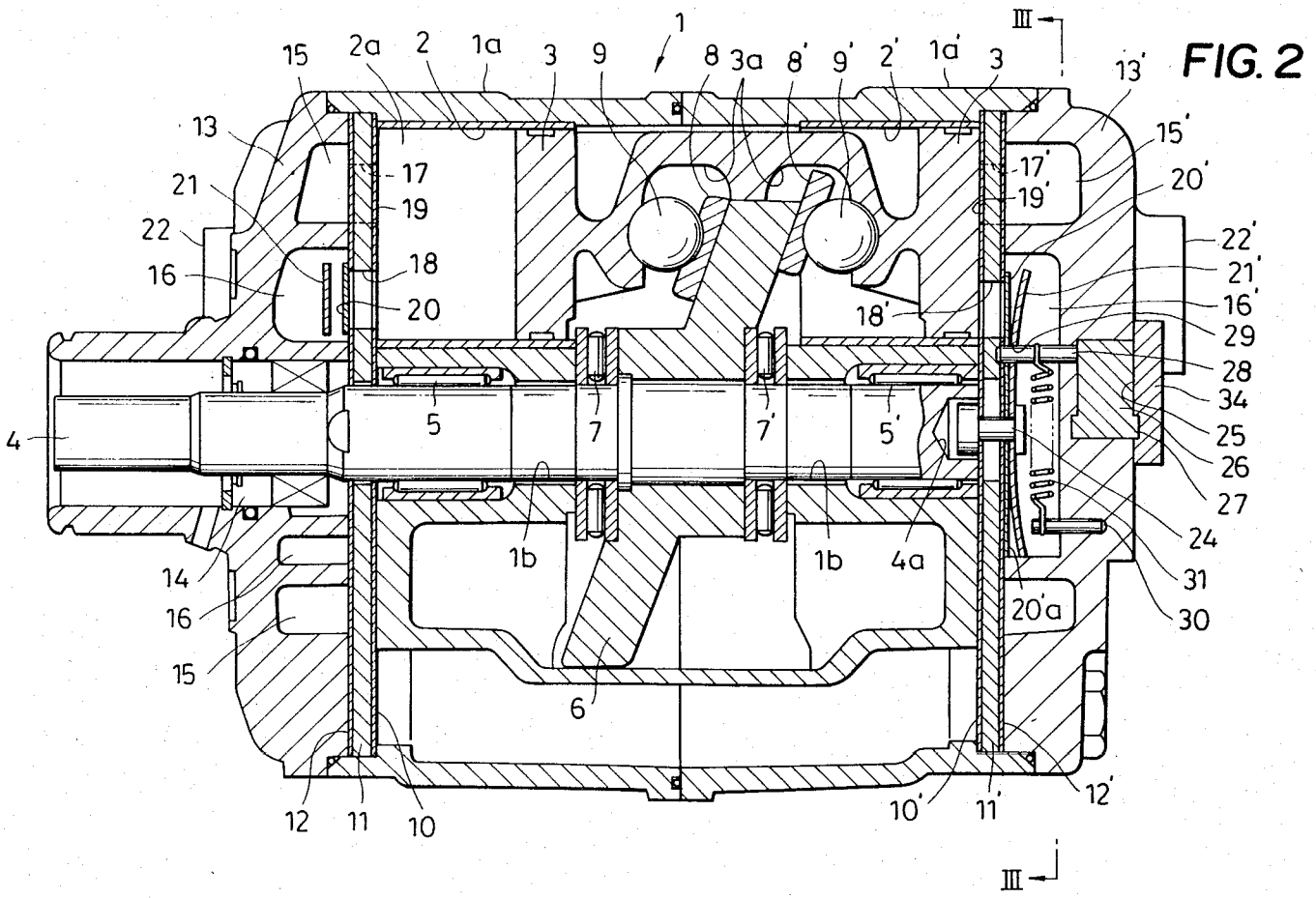
FIG. 2 is a vertical longitudinal sectional view of a variable delivery compressor according to an embodiment of the invention.
Figure 3:
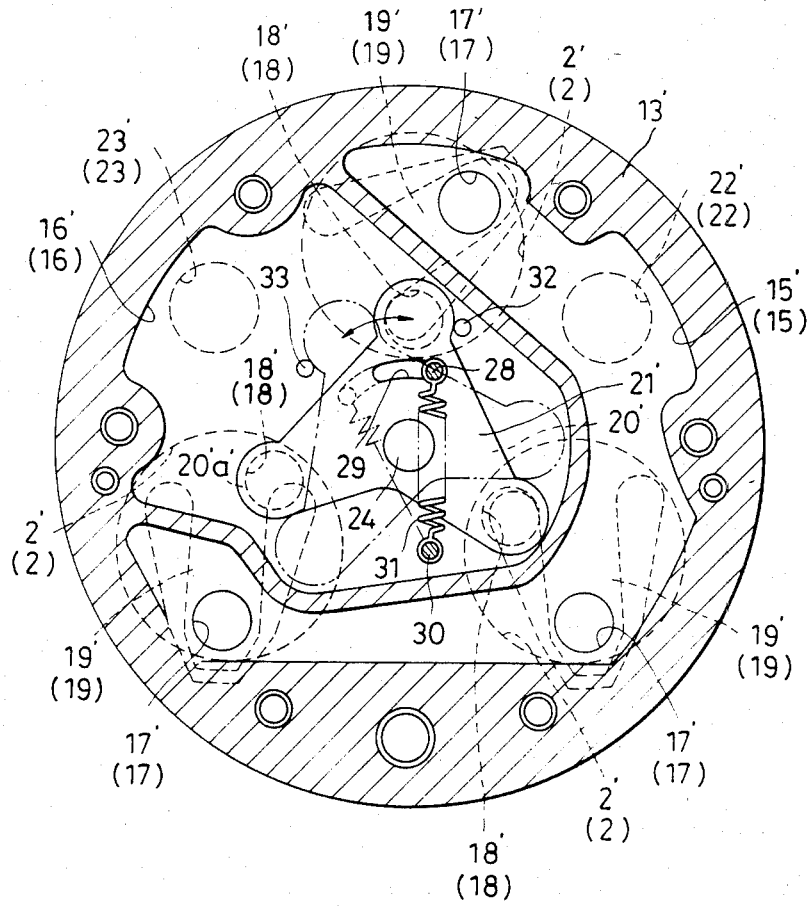
FIG. 3 is a sectional view taken along line III—III in FIG. 2.
Figure 4:
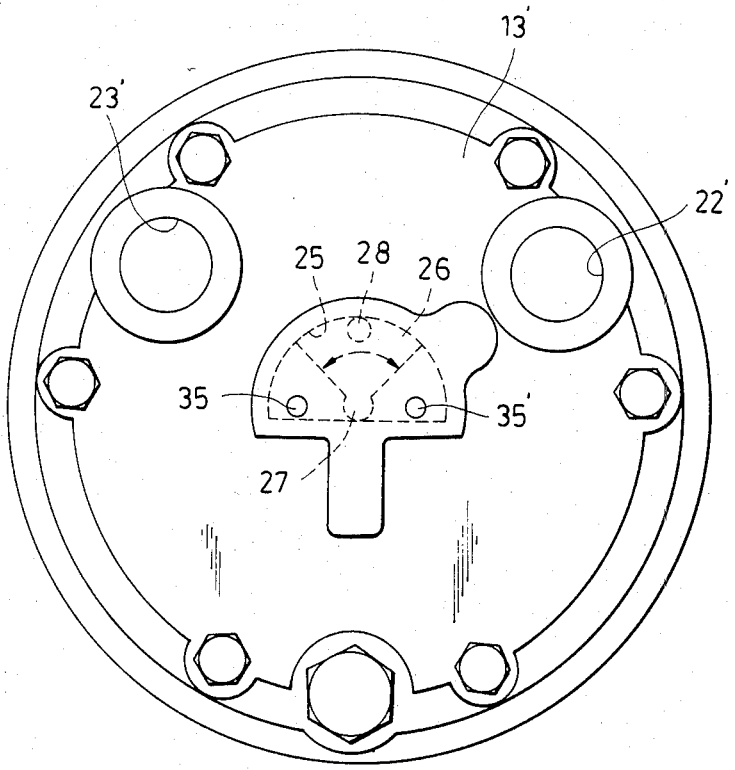
FIG. 4 is an end view of the compressor of FIG. 2.

An embodiment of the invention will now be described with reference to FIGS. 2 through 5 wherein the invention is applied to a swash plate type compressor for use in an air conditioning system for vehicles. Referring to FIGS. 2 through 4, reference numeral 1 designates the main body of the compressor, which comprises a cylinder block formed by a front half 1*a* and a rear half 1*a'* being symmetrical in shape and combined together. The front rear halves 1*a*, 1*a'* are each formed therein with three cylinders 2, 2', each one of which is shown in FIG. 2, with corresponding ones of them on the front side and on the rear side being axially aligned with each other. Double-acting pistons 3 are slidably received within the respective axially aligned front and rear cylinders 2, 2'. The opposite heads of each piston 3 cooperate with the inner peripheral surfaces of the cylinders and valve plates, hereinafter referred to, to define cylinder chambers 2*a*, 2'*a* therebetween, left one of which is now defined as shown in FIG. 2. The combined halves 1*a*, 1*a'* of the cylinder block 1 has an axially extending central hole 1*b* through which a drive shaft 4 extends, while being radially supported by roller bearings 5, 5'. A swash plate 6 is rigidly fitted on a central portion of the drive shaft 4, which has its boss axially supported by thrust bearings 7, 7' against inner end faces of bosses of the cylinder block halves 1*a*, 1*a'*. The swash plate 6 has its opposite side surfaces disposed in engagement with central recesses 3*a* formed in the pistons 3, via shoes 8, 8' and balls 9, 9' in such a manner that swinging rotation of the swash plate 6 causes reciprocating motions of the pistons 3 within their respective cylinders 2, 2'.

A front cylinder head 13 is secured to the outer end of the front half 1*a* of the cylinder block 1 with a valve sheet 10, a valve plate 11, and a gasket 12 interposed therebetween. The drive shaft 4 extends through the front cylinder head 13 and is sealed in an airtight manner by a sealing means 14 mounted within the front cylinder head 13. The cylinder head 13 is formed therein with a front suction chamber 15 and a front discharge chamber 16. Three suction ports 17 and three discharge ports 18 open in these respective chambers 15, 16, which are formed through the valve plate 11 at locations corresponding to the respective cylinders 2. Each of the suction ports 17 is provided with a suction valve 10 formed integrally on the valve sheet 10, and each of the discharge ports 18 is provided with a discharge valve 20 mounted on the valve plate 11 and a valve retainer 21. The front cylinder head 13 is formed with a front suction inlet 22 opening in the front suction chamber 15 as well as a discharge outlet 23 opening in the front discharge chamber 16.

A similar arrangement to the above is also provided on the side of the rear half 1*a'* of the cylinder block 1. Elements corresponding to ones on the side of the front half 1*a* are designated by parenthesized identical reference numerals in FIG. 3 showing a transverse cross section of a rear cylinder head 13'. To be specific, the rear cylinder head 13' is secured to the outer end of the rear half 1*a'* of the cylinder block 1 with a valve sheet 10', a valve plate 11' and a gasket 12' interposed therebetween. The rear cylinder head 13' is formed therein with a rear suction chamber 15' and a rear discharge chamber 16' which are out of communication with respective ones of the front suction chamber 15 and the front discharge chamber 16, within the compressor.

The rear cylinder head 13' is formed integrally with a rear suction inlet 22' and a rear discharge outlet 23' opening, respectively, in the rear suction chamber 15' and the rear discharge chamber 16'. Three suction ports 17' and three discharge ports 18' open, respectively, in the rear suction chamber 15' and the rear discharge chamber 16', which are formed through the valve plate 11' at locations corresponding to the respective cylinders 2'. Each of the suction ports 17' is provided with a suction valve 19' formed integrally on the valve sheet 10'. A discharge valve 20' is arranged within the rear discharge chamber 16' and disposed to close all the discharge ports 18', and is held against the valve plate 11' by a valve retainer 21'. The discharge valve 20' comprises a reed type valve body 20'a formed of a generally triangular plate, which is rotatably mounted on the valve plate 11' by a fulcrum shaft 24 penetrating a central portion of the valve body 20'a. The valve body 20'a has three pointed edges as closing portions disposed to overlap with open ends of the respective discharge ports 18' so as to close and open same. The fulcrum shaft 24 is formed of a double headed pin and also extends through the gasket 12', the valve plate 11' and the valve plate 10', with its one enlarged end received within a recess 4a formed in a rear end face of the drive shaft 4 and its opposite enlarged end disposed in urging contact with the gasket 12' to hold the valve reed 20'a against the valve plate 11'. On the other hand, as best shown in FIG. 4, the rear cylinder head 13' is formed therein with a piston chamber 25 having a generally semicircular shape, in which is arranged a rotary piston 26 having a sectorial shape in a manner rotatable about its integral fulcrum shaft 27 disposed concentrically with the fulcrum shaft 24 of the discharge valve 20'. A pin 28 is force fitted in an inner end face of the peripheral portion of the rotary piston 26, which axially inwardly extends and has its tip movably fitted in an arcuate elongate hole 29 which is formed through the valve body 20'a of the discharge valve 20' and the valve retainer 21' and curved about the fulcrum shaft 24. A tension spring 31 formed of a coil spring is bridged between the pin 28 and a pin 30 force fitted in an inner end face of the cylinder head 13'. The pin 30 is located such that when discharge valve 20' assumes one of its extreme positions as stated below, the spring 31 pulls the discharge valve 20' together with the valve retainer 21' in a manner biasing same toward a corresponding one of stoppers 32 and 33 planted on the valve plate 11' which determine respective ones of the above extreme positions of the discharge valve 20', so as to stably hold the valve 20' and the valve retainer 21' at the same extreme position. At one of the above extreme positions, the discharge valve 20' closes all the discharge ports 18' as shown as a position of the valve retainer 21' indicated by the solid line in FIG. 3, and at the other extreme position, the valve opens all the discharge ports 18' as shown as another position of the valve retainer 21' indicated by the two-dot chain line in FIG. 3. The spring 31 is elongated in a tauter state when the valve 20' assumes a position intermediate between the two opposite extreme positions than when it assumes one of the extreme positions. Thus, the rotary piston 26 is stably and positively held at either of the opposite extreme positions, by the action of the tension spring 31. Due to the arcuate elongate configuration of the hole 29 formed through the discharge valve 20' and the valve retainer 21', the spring 31 can be pivoted through a large angle about the pin 30, that is, the stroke of elongation and contration of the spring 31 caused by movement of the pin 28 along the elongate hole 29 is large enough to strongly bias the discharge valve 20' with its retainer 21' toward the stoppers 32, 33 at the respective extreme positions, to thereby stably and positively hold the discharge valve 20' in its opposite extreme positions.

The piston chamber 25 is covered by a cover 34, through which are formed first and second ports 35 and 35' for introducing fluid into and discharging same from respective opposite sides of the piston 26 in the chamber 25 to cause displacement of the discharge valve 20' in the discharge port-closing direction or clockwise direction in FIG. 4, and in the discharge port-opening direction or counterclockwise direction in FIG. 4.

Figure 5:
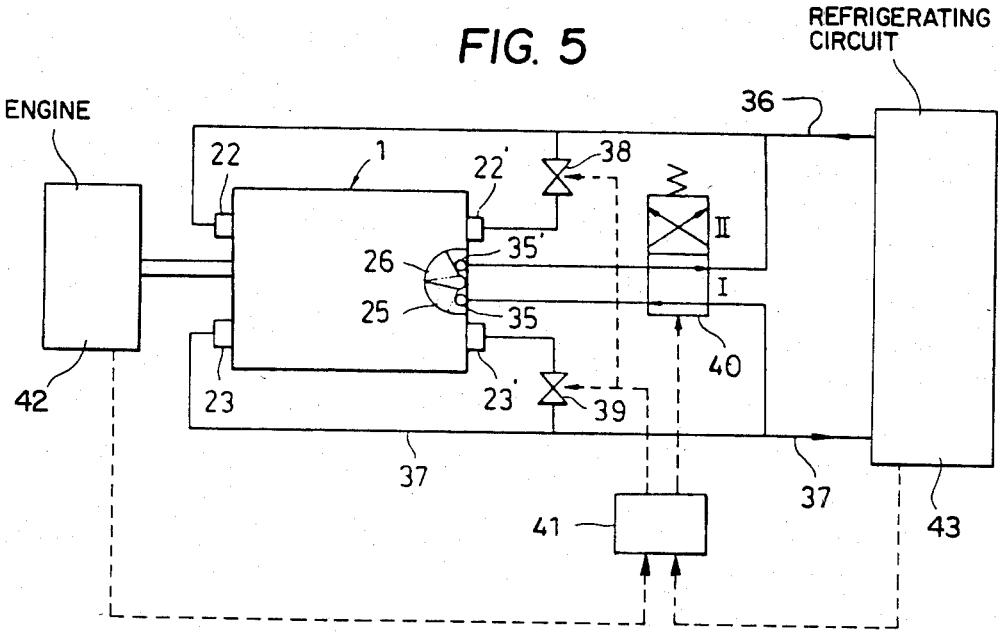
FIG. 5 is a block diagram of a control circuit for the compressor of FIG. 2.

FIG. 5 shows a control circuit for control of the compressor according to the invention. The suction inlet 22 and the discharge outlet 23 on the front side of the compressor are connected, respectively, to a lower pressure conduit 36 and a higher pressure conduit 37 of the refrigerating circuit 43 of an air conditioning system associated with the compressor. The suction inlet 22' and the discharge outlet 23' on the side of the rear cylinders which are to be rendered substantially ineffective during half delivery operation of the compressor are connected, respectively, to the lower pressure conduit 36 and the higher pressure conduit 37 through respective electromagnetic stop valves 38 and 39. The second port 35' and the first port 35 opening in the piston chamber 25 are arranged for selective connection to the lower pressure conduit 36 and the higher pressure conduit 37 by way of an electromagnetic selector valve 40. The electromagnetic stop valves 38, 39 and the electromagnetic selector valve 40 are arranged to be controlled by control signals from an electronic control unit 41. The electronic control unit 41 is adapted to supply the electromagnetic valves 38, 39 and 40 with control signals responsive to the rotational speed of the engine 42 of a vehicle on which the air conditioning system is installed, and/or the cooling load on the air conditioning system. For instance, when the rotational speed of the engine 42 is below a predetermined value or when the cooling load drops below a predetermined value, the control unit 41 supplies the electromagnetic valves 38, 39 and 40 with control signals having such values as to cause half delivery operation of the compressor. More specifically, when it is desired to perform full delivery operation of the compressor, the selector valve 40 is controlled to a position I in FIG. 5 wherein the higher pressure conduit 37 is connected to the first port 35 and the lower pressure conduit 36 is connected to the second port 35', while at the same time the stop valves 38, 39 are both opened. On the other hand, when it is desired to perform half delivery operation of the compressor, the selector valve 40 is switched to a position II in FIG. 5 wherein the higher pressure conduit 37 is connected to the second port 35' and the lower pressure conduit 36 is connected to the first port 35, and at the same time the stop valves 38, 39 are both closed. The stop valve 38 on the side of the suction inlet 22' may be omitted without a substantial functional change, if required.

The operation of the compressor constructed above will now be described: When the compressor is to be operated in full delivery mode, the electronic control unit 41 supplies control signals to the electromagnetic valves 38, 39 and 40 such that the selector valve 40 is controlled to the position I in FIG. 5, and at the same time the stop valve 38 on the side of the suction inlet 22' and the stop valve 39 on the side of the discharge outlet 23' are both opened, as previously noted. In this position, high pressure fluid in the higher pressure conduit 37 is introduced into the piston chamber 25 through the first port 35 to cause rotation of the rotary piston 26 toward the second port 35', which causes rotation of the discharge valve 20' and the valve retainer 21' toward the position of closing all the discharge ports 18' by means of the pin 28 on the rotary piston 26. In the above closing position, the valve retainer 21' and the valve body 20'a of the discharge valve 20' are brought into contact with the stopper 32. On this occasion, the spring 31 pulls the discharge valve 20' with its retainer 21' so as to bias same toward the stopper 32, to thereby stably and positively hold the discharge valve 20' in the discharge port-closing position. When the compressor is operated in this valve position, fluid in the lower pressure conduit 36 is guided through the front and rear suction inlets 22, 22', the front and rear suction chambers 15, 15', the suction ports 17, 17' and the suction valves 19, 19' in the order mentioned, and sucked into the cylinder chambers on the front and rear sides during the suction strokes of the double headed pistons 3, the fluid is compressed during the compression strokes of the pistons 3, and is discharged into the higher pressure conduit 37 through the front and rear suction ports 18, 18', the discharge valves 20, 20', the front and rear discharge chambers 16, 16' and the discharge outlets 23, 23' in the order mentioned, thus carrying out full delivery operation.

When half delivery operation is to be performed, that is, for instance, when the engine 42 of the vehicle is operated at a high speed so that the cooling capacity of the compressor increases, or when there occurs a drop in the cooling load on the air conditioning system, the control unit 41 supplies control signals to the electromagnetic valves such that the selector valve 40 is switched to the position II in FIG. 5 and at the same time the stop valves 38, 39 are both closed, as previously noted. In this valve position, high pressure fluid in the higher pressure conduit 37 is guided through the second port 35' into the piston chamber 25 to cause rotation of the rotary piston 26 toward the first port 35, which in turn causes rotation of the discharge valve 20' and the valve retainer 21' to the discharge port-opening position through the pin 28 on the rotary piston 26. As this changeover of the discharge valve 20' to the discharge port-opening position is effected, the coil spring 31 once becomes elongated on the way, and then comes into a state where it pulls the discharge valve 20' with its retainer 21' so as to bias them toward the stopper 33 and accordingly keep same in.contact with the stopper 33, thereby stably and positively holding the discharge valve 20' in its position to keep all the discharge ports 18' fully opened. When the compressor is operated in this discharge valve position, as the pistons are executed through their suction strokes on the front side, fluid in the lower pressure conduit 36 is guided through the suction inlet 22, the front suction chamber 15, the suction ports 17 and the suction valves 19 and sucked into the cylinder chambers on the front side, and then the fluid is compressed and discharged into the higher pressure conduit 37 through the discharge ports 18, the discharge valves 20, the front discharge chamber 16 and the discharge outlet 23 in the order mentioned, as the pistons go through their compression strokes. In this way, the cylinders 2 on the front side are fully effectively operated.

On the other hand, since during the half delivery operation, the stop valves 38, 39 are both closed to isolate the cylinders 2' on the rear side from the cylinders 2' on the front side. On this occasion, since the sum of the volumes of the cylinder chambers on each side with the pistons being different in phase remains constant during operation of the compressor as previously noted, fluid from one of the cylinders 2' on the rear side which is on the compression stroke is discharged into the discharge chamber 16' through corresponding one of the discharge ports 18' which are fully opened by the discharge valve 20' and impart no substantial discharge resistance to the fluid, while at the same time part of the fluid in the discharge chamber 16' is sucked into one of the cylinder chambers 2' on the suction stroke, through the corresponding discharge port 18' which is fully opened, without being sucked through the corresponding suction valve 19' which imparts some suction resistance to the fluid. That is, on the rear side of the compressor, the fluid is neither compressed nor expanded during operation of the compressor, but it is merely circulated in a free state between the cylinder chambers 2'a via the discharge chamber 16'. In this way, the cylinders 2' on the rear side are kept in a completely ineffective state.

Since during such half delivery operation of the compressor the fluid on the side of the ineffective cylinders is merely freely circulated between the cylinder chambers, without being discharged into the refrigerating circuit 43, the amount of fluid circulated in the refrigerating circuit 43 is approximately 50 percent of that during full delivery operation of the compressor. Further, since the fluid on the side of the ineffective cylinders is neither compressed nor expanded, the loss of power of the compressor can be minimum, making it possible to keep the total power consumption at approximately 50 percent of that during full delivery operation.

Although the illustrated embodiment is applied to a swash plate type compressor having three cylinders on each side, the invention is not limited to such type compressor, but it may be applied to any double acting compressor if only it is such a type that two groups of cylinders are provided, the cylinders of each group being circumferentially arranged at equal intervals and extending parallel with each other, corresponding ones of the cylinders of the two groups being axially aligned with each other, the pistons being disposed for reciprocal movement within their respective cylinders of each group with equal phase differences. The cylinders on the front side may be rendered substantially ineffective, instead of the cylinders on the rear side. Although the discharge valve on the rear side may be adapted to be manually controlled for keeping all the discharge ports fully opened, a combination of a rotary piston actuatable by discharge fluid from the compressor and an electromagnetic selector valve controlled by a control signal from an electronic control unit as in the present embodiment is more advantageous in that automatic step control of the delivery or discharge quantity of the compressor is feasible which is effected in response to the rotational speed of the vehicle engine and/or the cooling load on the air conditioning system.

While a preferred embodiment of the invention has been described, variations thereto will occur to those skilled in the art within the scope of the present inventive concepts which are delineated by the following claims.

What is claimed is:

1. A compressor comprising: a cylinder block having a first group of cylinders and a second group of cylinders formed therein, said cylinders of each of said first and second groups being circumferentially arranged at equal intervals and extending parallel with each other, corresponding ones of said cylinders of said first and second groups being axially aligned with each other; a plurality of double acting pistons received within said axially aligned corresponding ones of said cylinders, said pistons each cooperating with said corresponding ones of said cylinders to define cylinder chambers therebetween at opposite ends thereof; driving means for causing reciprocal motions of said pistons within said cylinders of each of said first and second groups with equal phase differences; first and second cylinder heads arranged at opposite ends of said cylinder block; first and second suction chambers formed, respectively, within said first and second cylinder heads, said first and second suction chambers being connected to one side of a compression fluid circuit associated with said compressor, said first and second suction chambers being out of communication with each other within said compressor; first and second discharge chambers formed, respectively, within said first and second cylinder heads, said first and second discharge chambers being connected to another side of said compression fluid circuit, said first and second discharge chambers being out of communication with each other within said compressor; a plurality of discharge ports communicating respective ones of said cylinder chambers defined within said cylinders of one of said first and second groups with a corresponding one of said first and second discharge chambers; a rotary discharge valve arranged within said corresponding one discharge chamber and disposed to close said discharge ports, said discharge valve comprising a fulcrum shaft arranged within said corresponding one discharge chamber, and a valve body rotatably supported by said fulcrum shaft, said valve body having a plurality of closing peripheral portions disposed to overlap with respective ones of said discharge ports; changeover means for selectively causing said discharge valve to assume a first position wherein said discharge valve keeps all said discharge ports closed for normal valving action thereof, and a second position wherein said discharge valve keeps all said discharge ports opened; a stop valve connected between said corresponding one discharge chamber and said another side of said compression fluid circuit, for interrupting the communication therebetween; and control means for controlling said changeover means and said stop valve in synchronism with each other, said control means being operable to cause said discharge valve to assume said second position thereof through said changeover means, and at the same time to cause said stop valve to assume a closed position thereof.

2. A compressor as claimed in claim 1, wherein said changeover means comprises: a piston chamber having first and second ports; a rotary piston rotatably received within said piston chamber; coupling means drivingly coupling said rotary piston with said valve body of said discharge valve; and switching means selectively connectable with said first port and said second port of said piston chamber for supplying said piston chamber with operating fluid through one of said first and second ports connected with said switching means; whereby when said switching means is connected with said first port, said operating fluid causes rotation of said rotary piston in one direction to cause said coupling means to displace said discharge valve to one of said first and second positions thereof, and when said switching means is connected with said second port, said operating fluid causes rotation of said rotary piston in a direction opposite to said one direction to cause said coupling means to displace said discharge valve to the other one of said first and second positions thereof.

3. A compressor as claimed in claim 1, wherein said driving means comprises a drive shaft extending through said cylinder block, and a swash plate secured on said drive shaft and drivingly engaging said pistons within said cylinders.

4. A compressor as claimed in claim 2, further including a tension spring engaging said coupling means, said rotary piston being disposed for rotation concentrically with said fulcrum shaft of said discharge valve, and first and second stoppers for determining said first and second positions of said discharge valve, respectively, said valve body of said discharge valve having an elongate hole arcuately extending about said fulcrum shaft, said coupling means having one end secured to said rotary piston and another end movably engaged in said elongate hole, said tension spring being disposed such that when said discharge valve assumes one of said first and second positions thereof, said tension spring pulls said discharge valve so as to bias same toward a corresponding one of said first and second stoppers, thereby allowing said discharge valve to be stably and positively held at either of said first and second positions thereof.

5. A compressor as claimed in claim 2, wherein said switching means comprises an electromagnetic selector valve, said compressor having a suction side and a discharge side, said electromagnetic selector valve being disposed to selectively connect said suction side and said discharge side of said compressor with said first and second ports of said piston chamber, whereby discharge fluid from said compressor is supplied as said operating fluid to said piston chamber through one of said first and second ports connected to said discharge side of said compressor, and at the same time operating fluid from said piston chamber is supplied to said suction side of said compressor through the other one of said first and second ports connected to said suction side of said compressor.

6. A compressor as claimed in claim 5, wherein said stop valve comprises an electromagnetic valve, said control means comprising electronic means adapted to control said electromagnetic selector valve to cause said discharge valve to assume said second position thereof and at the same time to control said stop valve to assume said closed position thereof.

7. A compressor as claimed in claim 6, further including a second electromagnetic stop valve connected between one of said first and second suction chambers corresponding to said one group of said cylinders and said one side of said compression fluid circuit for interrupting communication therebetween, said control means being adapted to control said electromagnetic selector valve to cause said discharge valve to assume said second position thereof and at the same time to control said first-mentioned stop valve to assume said closed position thereof and said second electromagnetic stop valve to assume a closed position thereof.

8. A compressor as claimed in claim 6, wherein said compression fluid circuit comprises a refrigerating circuit in an air conditioning system for a vehicle having an engine, said compressor being driven by said engine, said control means being responsive to at least one control parameter of the rotational speed of said engine and cooling load on said air conditioning system.

* * * * *